US005522104A

United States Patent [19]

Little

[11] Patent Number: 5,522,104

[45] Date of Patent: Jun. 4, 1996

[54] LATERAL RECUMBENCY SUPPORT PILLOW

[76] Inventor: Andrea J. Little, 13887 Highway 55, McCall, Id. 83638

[21] Appl. No.: 317,320

[22] Filed: Oct. 4, 1994

[51] Int. Cl.[6] ..... A47C 20/00

[52] U.S. Cl. ..... 5/632; 5/655

[58] Field of Search ..... 5/630, 631, 632, 5/652, 655, 449, 481

[56] References Cited

U.S. PATENT DOCUMENTS

| | | | |
|---|---|---|---|
| 1,045,228 | 11/1912 | Weltmer | 5/630 |
| 3,781,931 | 1/1974 | Knickerbocker | 5/657 |
| 3,924,282 | 12/1975 | Bond | 5/632 |
| 4,233,700 | 11/1980 | Spann | 4/632 |
| 4,506,396 | 3/1985 | Ritchie, Jr. et al. . | |
| 4,733,836 | 3/1988 | Barnes | 5/630 |
| 4,840,362 | 6/1989 | Bremer | 5/632 |
| 5,012,539 | 5/1991 | Grigg . | |
| 5,182,828 | 2/1993 | Alivizatos . | |
| 5,216,772 | 6/1993 | Clute . | |

*Primary Examiner*—Flemming Saether
*Attorney, Agent, or Firm*—Margaret M. Dunbar

[57] ABSTRACT

A torso and lumbar support and position stabilizing pillow for a lateral recumbency position comprising a substantially planar base member, a main body and a lumbar support member, the main body having a top surface, a bottom surface, an outside surface and an inside surface. The main body is shaped such that the bottom surface is planar and attached to the base member, while the outside surface of the main body is also planar and perpendicular to the base member, with the inside surface of the main body being opposite the outside surface and disposed at an acute angle with respect to the base member. Optionally, the inside surface can be concave to accommodate the natural curve of the spine, allowing room for the protrusion of a person's shoulder and buttocks areas. In use, the pillow is placed in firm contact with a person's back and side to provide lumbar support when a person is lying in lateral recumbency, on their side. In addition to reducing muscle strain, the support pillow also reduces the amount of muscle tension and effort that must be put forth to maintain this position. This results in reduced fatigue.

9 Claims, 6 Drawing Sheets

LATERAL RECUMBENCY SUPPORT PILLOW

BACKGROUND OF THE INVENTION

1. Technical Field

The present invention relates to a torso and lumbar support pillow for supporting a person in lateral recumbency, that is lying on a person's side.

2. Background

It is necessary or desirable under a variety of circumstances for a person to lie on their side in a position that does not allow them to take advantage of human anatomical structures that would allow the person to rest on their side in a more semi-lateral position with minimal effort. When a person needs to maintain their position lying on their side without leaning back to rest on some of the larger muscles in the rump and portions of the shoulder, this position can cause strain to muscles in the lumbar region of the back, stomach, legs and hips, and fatigue from the effort required to maintain this nonresting position in lateral recumbency. The reasons why a person might desire or need to maintain their body in such a position include, but are not limited to, during pregnancy, breast feeding while lying down, keeping pressure off injured tissue, as in the case of hemorrhoids, burns and abrasions, stabilizing a lateral recumbency position for post-surgical needs, and therapeutic treatments, such as to topical agents, heat, etc.

A number of articles have been designed to aid a person in maintaining a position of lateral recumbency. In U.S. Pat. No. 5,182,828, Alivizatos, a support pillow is described that is a fabric wedge or roll filled with a compressible substance. Although the pillow of Alivizatos does aid the lateral recumbency position, the fabric filled with the compressible substance does not provide adequate support to prevent the fatigue or strain that is experienced by the lumbar region of the back in maintaining this position on the lateral edge of the pelvis. In addition, Alivizatos describes a front roll or wedge to accompany the back-placed roll or wedge; under circumstances, such as when breast feeding, a front wedge may obstruct the breast and is not always possible to place or helpful to use.

U.S. Pat. No. 5,272,780, Clute, also discloses a support pillow. Clute describes a front and back pillow as well and as previously explained, a front pillow is not always helpful or adequate in supporting this lateral recumbency position. Like the other prior art, the back pillow does not provide adequate support to prevent the fatigue or strain that is experienced by the lumbar region of the back in maintaining this position on the lateral edge of the pelvis. In addition, Clute is primarily dedicated to holding an infant in a side-resting position, and is not designed to provide the necessary support for an adult body frame.

U.S. Pat. No. 4,506,396, Ritchie, Jr. et al. teaches a support pillow for a person lying on their side for use by a pregnant woman. The pillow in Ritchie is not designed to provide lumbar support for a person positioned on their side, since it is not necessary for a pregnant woman to maintain a position strictly on her side, and she may roll slightly backwards into a semi-lateral position to take advantage of natural anatomical structures that allow her to rest substantially on her side, but in a more natural and restful position. In addition, the pillow in Ritchie is soft and includes a front support pillow, both of which are not adequate to support a person in lateral recumbency and a front roll may in fact be inappropriate in aiding or hinder the maintenance of the lateral recumbency position by a person.

U.S. Pat. No. 5,012,539, Grigg, teaches an inflatable, triangular multiple-use pillow. While Grigg may be somewhat beneficial for multiple purposes, such as knee support or wrist support, the triangle shape is inadequate to provide lumbar support to help maintain a lateral recumbency position and reduce the strain and fatigue associated with maintaining the side resting position.

It is therefore an object of the present invention to provide a lateral support pillow for increased support of a person in a lateral recumbency position.

It is a further object of the present invention to provide a support pillow that assists in position stabilizing for a person in a lateral recumbency position.

It is yet another object of the present invention to provide a lateral support pillow for a woman that is in the lateral recumbency position for breast feeding.

It is a further object of the present invention to provide a lateral support pillow with improved structure for support of the lumbar region of the back to reduce strain and fatigue associated with maintaining a lateral recumbency position for a sustained period of time.

A still further object of the present invention is to provide a support pillow with improved support structure to support the torsos and lumbar back area of a woman during pregnancy.

DISCLOSURE OF INVENTION

The invention is a torso and lumbar support and position stabilizing pillow for a lateral recumbency position comprising a substantially planar base member, a main body and a lumbar support member. The main body has a top surface, a bottom surface, a pair of end surfaces and an inside surface. The main body is shaped such that the bottom surface is planar and attached to the base member. The end surface of the main body is also planar and perpendicular to the base member. The inside surface of the main body is adjacent the end surfaces and disposed at an acute angle with respect to the base member. Optionally, the inside surface can be concave to accommodate the natural curve of the spine, allowing room for the protrusion of a person's shoulder and buttocks areas.

The lumbar support member has a longitudinal axis, a back surface, a front surface, and a pair of end surfaces. The lumbar support member is shaped such that the back surface is shaped to conform to the inside surface of the main body and attached to the inside surface of the main body. The front surface of the lumbar support member is substantially convex shaped to provide support to the lumbar region of a person's back. The pair of end surfaces on the lumbar support member extend between the front and back surfaces along the longitudinal axis of the lumbar support member and are angled in toward the center of the front surface. The base member, main body and lumbar support member are each symmetrical with respect to a plane perpendicular to, and at the midpoint of, the longitudinal axis of the lumbar support member to permit the use of the support pillow by a person in either right or left lateral recumbency.

In use, the pillow is placed in firm contact with a person's back and side to provide side and lumbar support when a person is lying in lateral recumbency, on their side. Examples of uses for the support pillow include helping to support and maintain the position of a person in a lateral recumbent position on their side during pregnancy, for breast feeding, injuries to a person's side or back, such as muscle injuries and cuts or abrasions that need to have contact with surfaces minimized or support to minimize muscle strain. Further, examples of uses for the support pillow include conditions such as hemorrhoids and applications of topical treatments such as creams, powders or bandages. When in a lateral recumbency, lying down position, the pelvis is rolled past a normal resting position and onto the lateral surface of the pelvis. In order to maintain this lateral lying down position a person must make a continual effort and lumbar muscles of the back become fatigued and can become strained during this process. Additionally, in this lateral position, the lumbar vertebrae are under more than normal stress and the associated muscle groups must work harder because of their close proximity to the pelvis. With the support pillow firmly placed against the lumbar region of the back while in this lying down position, this position can be maintained more easily and with less likelihood of muscle strain. In addition to reducing muscle strain, the support pillow also reduces the amount of muscle tension and effort that must be put forth to maintain this position. This results in reduced fatigue and reduced muscle strain.

BEST MODE FOR CARRYING OUT INVENTION

Figure 1:
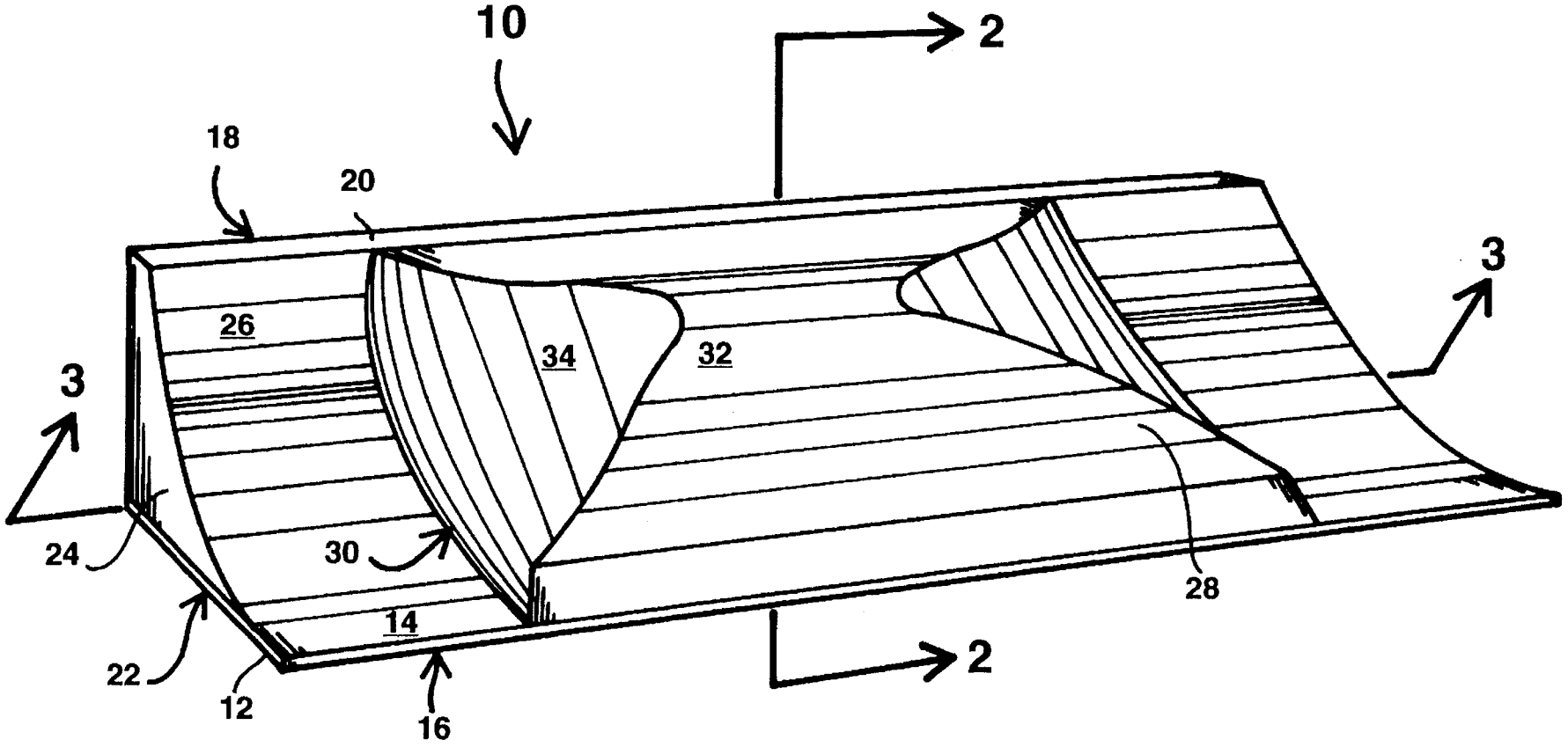
FIG. 1 is a representative front three-quarter elevation view of the preferred embodiment of the invention.

Referring now to FIGS. 1 through 4, a support pillow for lateral recumbency is illustrated in accordance with the principles of the present invention. Support pillow 10 is generally comprised of base member 12, main body 18, and lumbar support member 28.

In the preferred embodiment, this invention, support pillow 10, is fabricated in three separate units, base member 12, main body 18 and lumbar support member 28. These three units are then attached to each other in an appropriate fashion, depending upon the material from which they are fabricated. In the preferred embodiment of support pillow 10, both base member 12 and main body 18 are fabricated out of a moderately firm foam rubber of a character that is comparatively resistant to deformation so as to provide a large amount of support, while still being of sufficient pliability to be comfortable under a person's body weight. Lumbar support member 28 is fabricated from a softer foam rubber in the preferred embodiment that comparatively is less stiff than the foam rubber used for main body 18, which in turn is less stiff than the foam rubber used to fabricate base member 12. Lumbar support 28, however, is preferably capable of moderate deformation so as to fit virtually all body shapes, sizes and weights to provide comfort as well as support in the lumbar region when using support pillow 10.

Figure 2:
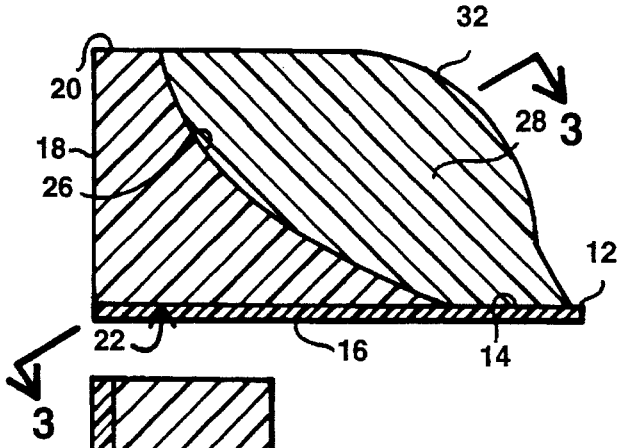
FIG. 2 is a cross section of FIG. 1 taken along line 2—2.
Figure 3:
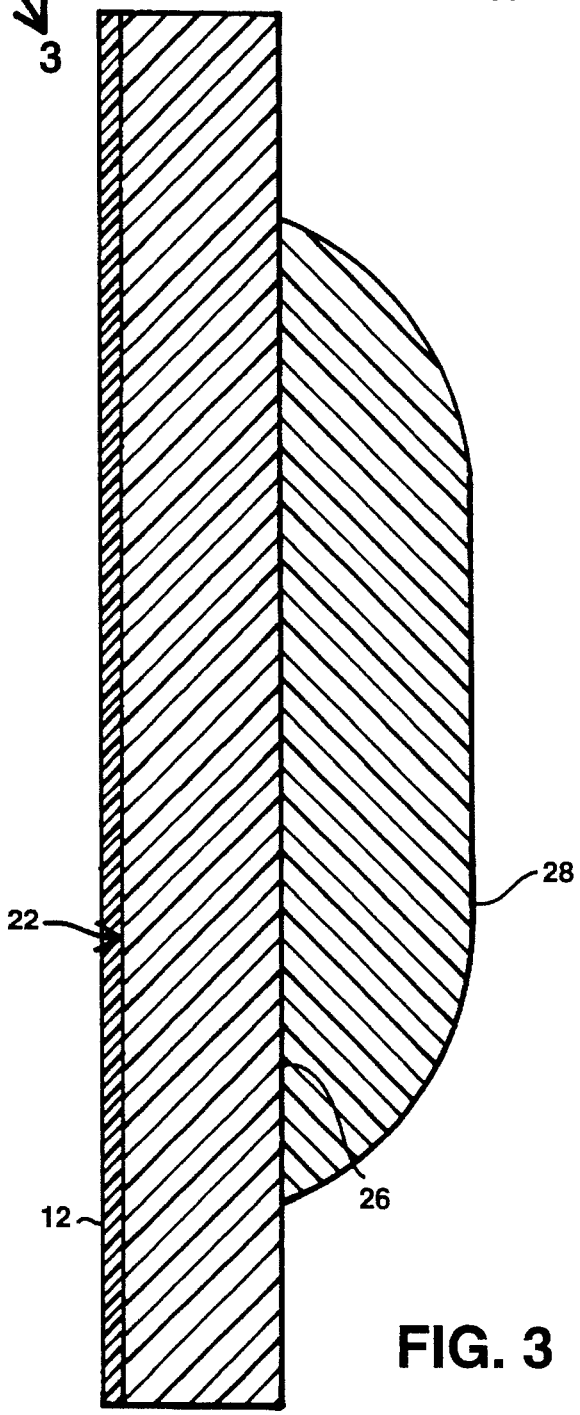
FIG. 3 is a cross-section view of FIG. 1 taken along line 3—3.

Base member 12 is substantially planer and is comprised of top surface 14, and bottom surface 16, as seen in FIGS. 1 through 3. Main body 18 includes top surface 20, bottom surface 22, a pair of and surfaces 24 and inside surface 26, as shown in FIGS. 1 through 3. Bottom surface 22 of main body 18 is generally planer and permanently affixed to top surface 14 of base member 12. End surface 24 is perpendicular to both top surface 14 of base member 12, bottom surface 22 of main body 18. End surface 24 of main body 18 is flush with one edge of base member 12. Inside surface 26 of main body 18 is adjacent end surface 24 and disposed at an acute angle with respect to top surface 14 of base member 12, as can be seen in FIGS. 1 through 3. In the preferred embodiment, inside surface 26 angles in the direction of top surface 20 of main body 18 in a non-linear, concave fashion, such that inside surface 26 is sickle or parabola shaped, but in other embodiments a linear slope could be used. By virtue of this gentle angular sloping of inside surface 26 of main body 18, when main body 18 is attached to base member 12, inside surface 26 merges in a smooth fashion with base member 12, as seen in FIGS. 1 through 3. Base member 12 extends past inside surface 26 of main body 18 for accepting the smooth transition of front surface 32 with lumbar support 28, as shown in FIGS. 1 and 2. Main body 18 and lumbar support member 28 are attached to base 12 in the preferred embodiment by the use of any conventional foam adhesive, generally applied as an aerosol spray.

Figure 4:
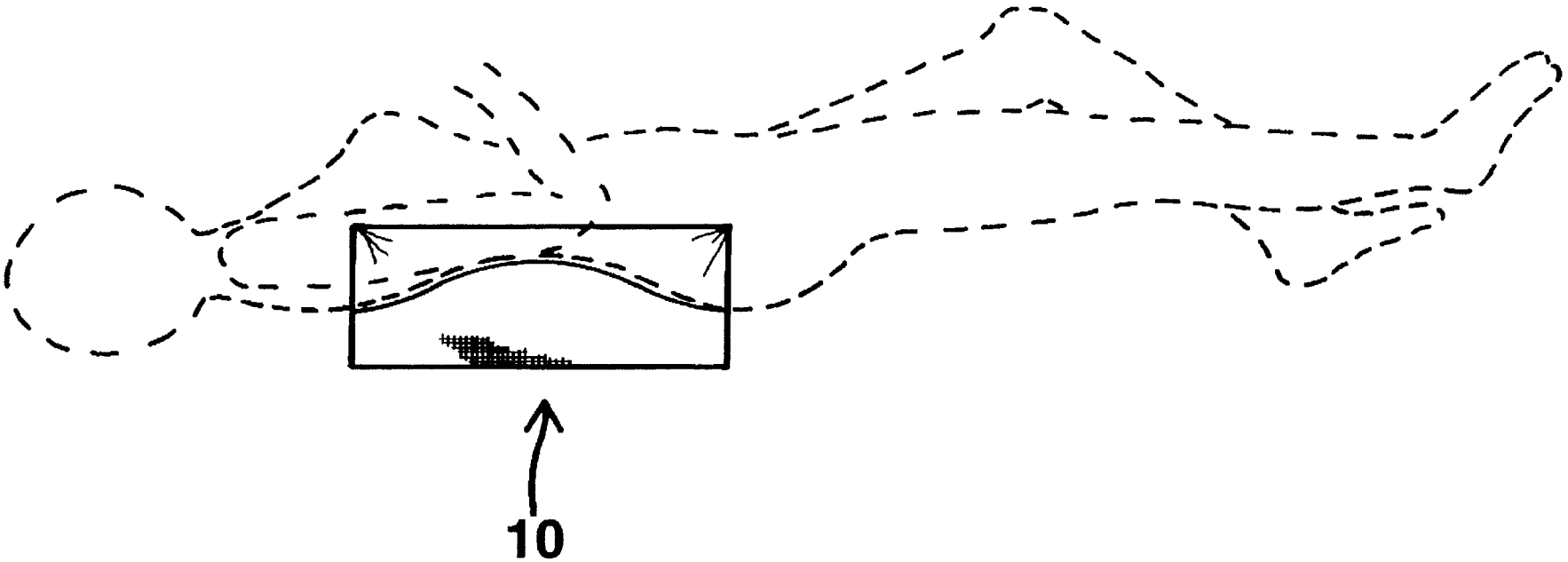
FIG. 4 is an bottom view showing the preferred embodiment of the present invention in use.
Figure 5:
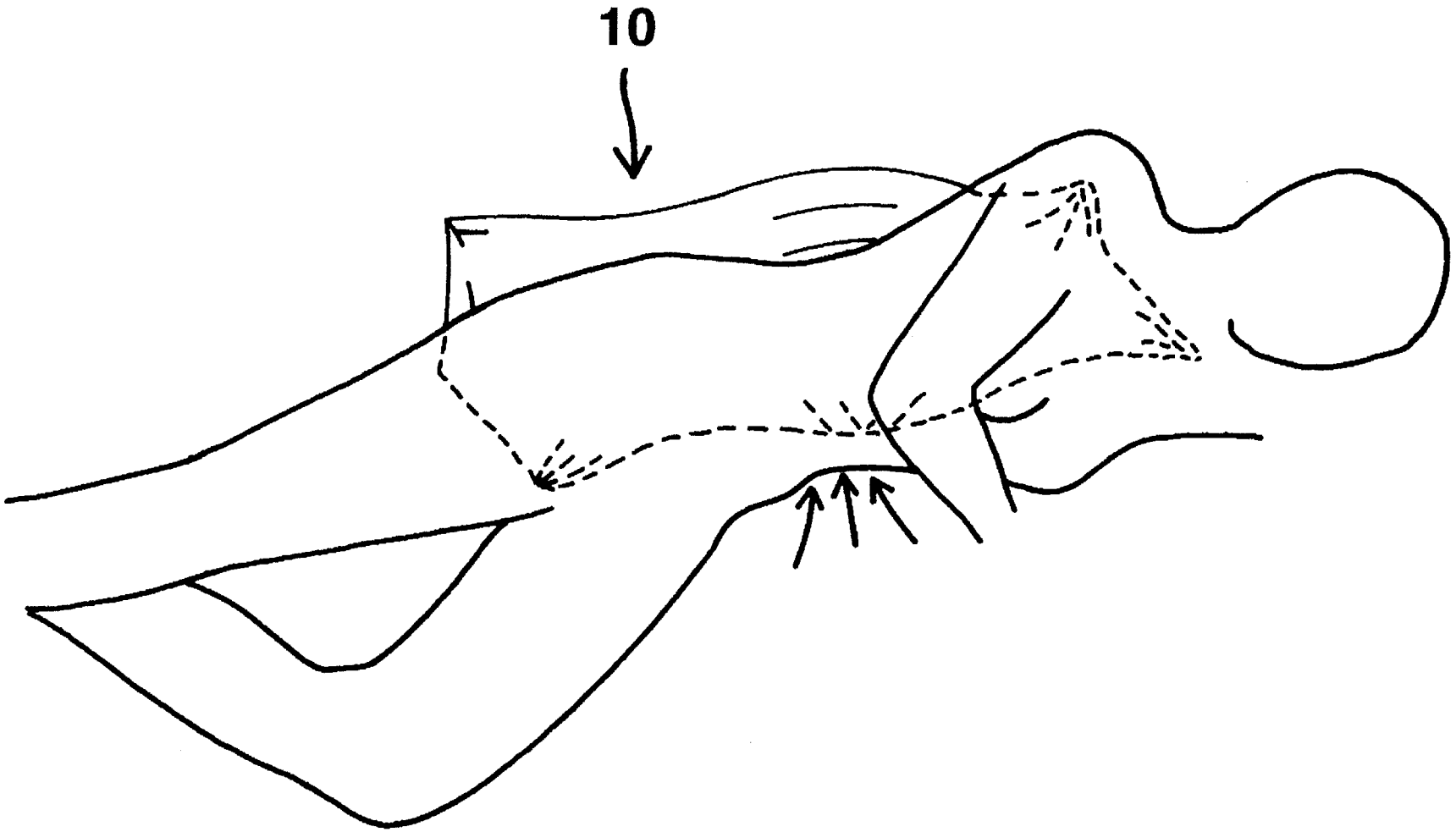
FIG. 5 is a front perspective view showing the preferred embodiment of the invention in use.

Lumbar support member 28 is comprised generally of a back surface 30 and front surface 32 and a pair of end surfaces 34, as can be seen in FIGS. 2 and 3. Back surface 30 is shaped to conform to inside surface 26 of main body 18. In the preferred embodiment, back surface 30 is generally convex in shape, so as to conform to the generally sloping or parabola contour of inside surface 26 of main body 18, as shown. Front surface 32 of lumbar support member 28 is substantially convex shaped so as to conform to the natural conformation of the back and to provide support for the lumbar region of a person's back, as can be seen in FIG. 4. Lumbar support member 28 is positioned on inside surface 26 of main body 18 in such a manner that front surface 32 merges smoothly into top surface 20 of base 12, as seen in FIGS. 1 through 3. In the preferred embodiment, front surface 32 of lumbar support member 28 is flat or of slight concavity near the region in which it meets base member 12, so as to provide support and comfort under the user's side, as can be seen by the force arrows in FIG. 5. End surfaces 34 extend between front surface 32 and back surface 30 of lumbar support member 28. End surfaces 34 are concave and angled in toward the center of front surface 32, so as to provide a generally smooth rounded contour across the entire support region of lumbar support member 28, as shown in FIGS. 1 and 3. The support region of lumbar support 28 consists of end surfaces 34 in conjunction with front surface 32.

In the preferred embodiment, base member 12, main body 18 and lumbar support member 28 are each symmetrical with respect to a plane perpendicular to the longitudinal axis of lumbar support member 28 at the midpoint of the longitudinal axis.

In the preferred embodiment, support pillow 10 is fabricated from dense celled foam in three different units. The option exists to produce each unit or member from a different density and stiffness of foam. For example, base member 12 can be a very stiff foam rubber, main body 22 a moderately firm foam and lumbar support 28 a comparatively softer, but still supportive, density of foam rubber. In other embodiments, lumbar support pillow 10 may be manufactured in a single unitary structure. Support pillow 10 may be fabricated out of dense celled foam, or other types of foam, or compliant and resilient materials such as soft rubber, composite materials, or other appropriate polymers, such as polypropylene. Support pillow 10 may also be manufactured using other materials such as an inflatable pillow with either 3 separate compartments or of a unitary form, of the shape described herein.

In use, pillow 10 is placed in firm contact with a person's back and side to provide lumbar and side support and support of the torso when a person is lying down on their side, as shown in FIG. 4. The term torso is meant to include the upper and lower back, and all of the pelvis. One example of when a person would need lumbar support when lying on their side is a woman breast feeding in a lying down or lateral recumbency position. When a person is lying on their side in a semi-lateral and resting position, their pelvis is tilted slightly backwards and this position can be maintained with relatively little effort or muscle tension. When breast feeding in a lying down position, a woman must be rolled slightly forward of this semi-lateral resting position in order to properly present her breast to the feeding infant. In order to maintain this lateral lying down position for breast feeding, a woman must make a continual effort and her stomach, legs, hips and lumbar muscles of the back become fatigued and can become strained during this process.

In order to accomplish the breast feeding, the woman must often maintain this position for 30 minutes or longer. In this position, the pelvis is rolled past a normal resting position and onto the lateral surface of the pelvis. In this lateral position, the lumbar vertebrae are under more than normal stress and the associated muscle groups must work harder because of their close proximity to the pelvis. With lumbar support pillow 10 firmly placed against the lumbar region of the woman's back and side while in this lying down breast feeding position, the woman can maintain this position more easily and with less likelihood of muscle strain. In addition to reducing muscle strain, lumbar support pillow 10 also reduces the amount of muscle tension and effort the woman must put forth to maintain this lying down position. This results in reduced fatigue, increased relaxation and ease of nursing for the woman.

Figure 6:
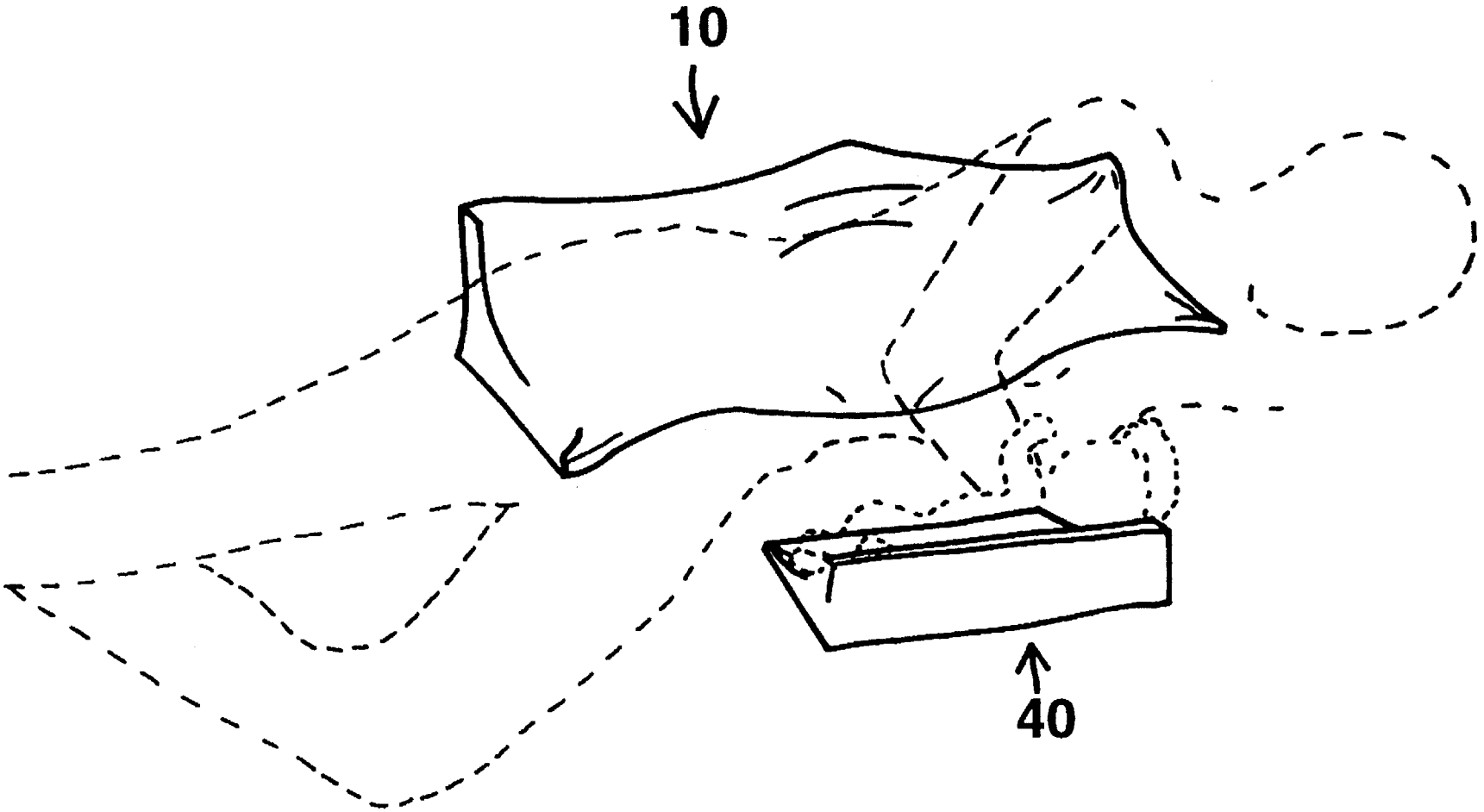
FIG. 6 is a front perspective view showing the preferred embodiment of the invention and an infant auxiliary pillow in use as a breast feeding system.
Figure 7:
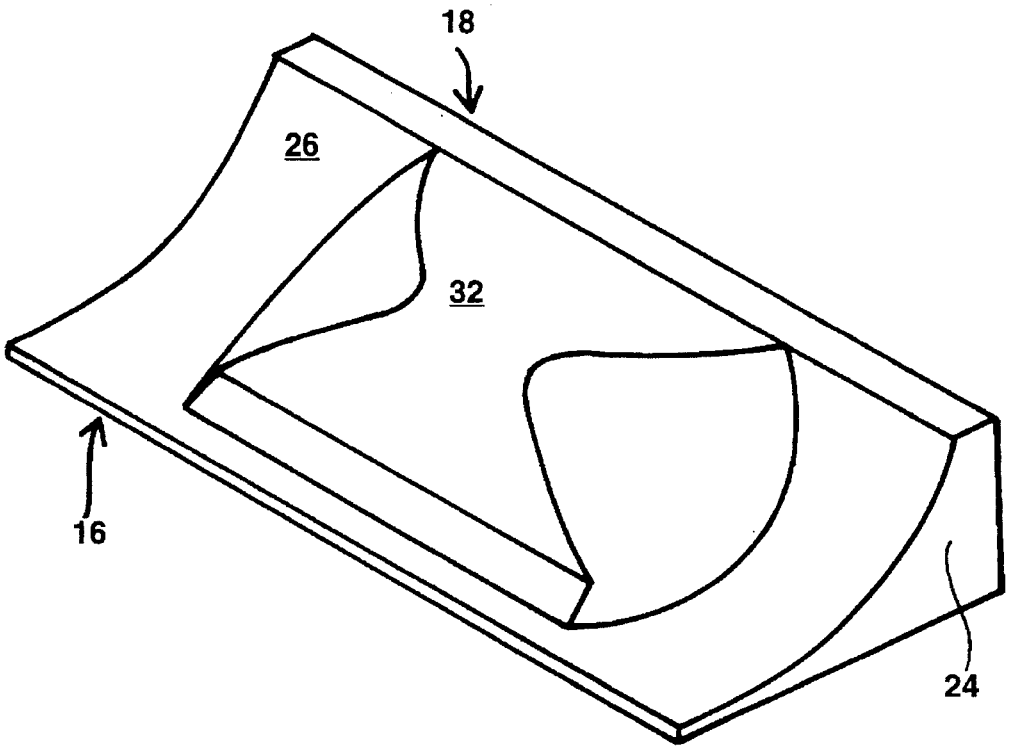
FIG. 7 is an isometric view of an embodiment of the invention where it is of unitary construction.
Figure 8:
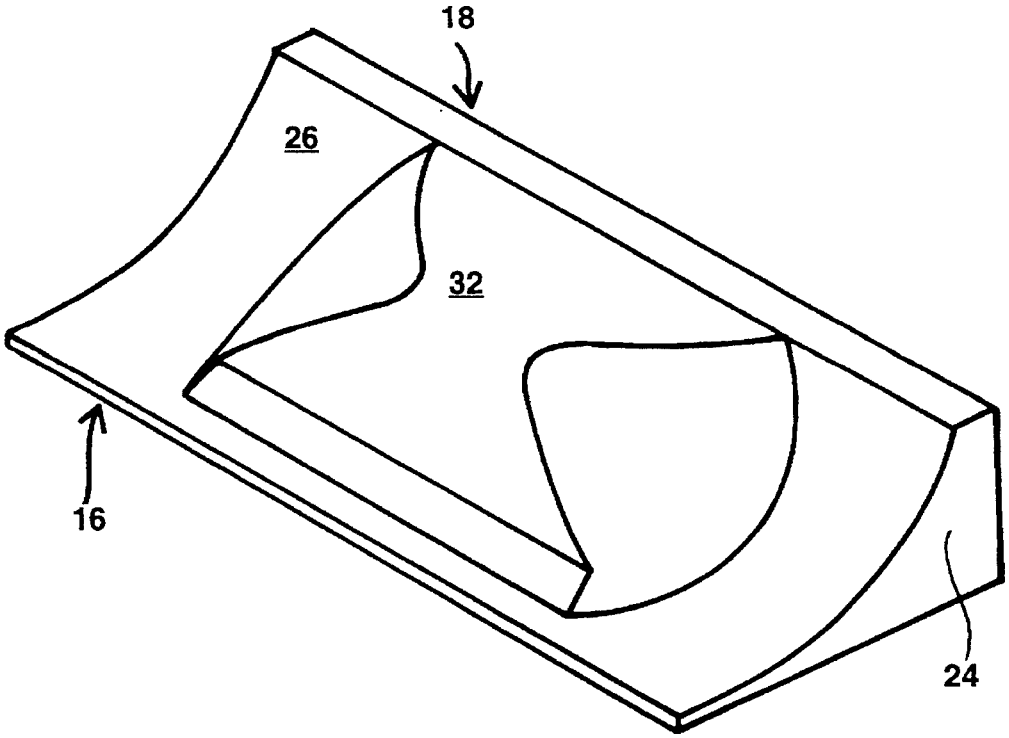
FIG. 8 is an isometric view of an embodiment showing an inflatable pillow according the invention.

In one embodiment of the invention, an auxiliary pillow 40 provides an anti-roll support structure for keeping the feeding infant on its side, as shown in FIG. 6. The auxiliary pillow 40 is of similar shape to main body 18, but approximately half the length of main body 18 in a direction parallel to the longitudinal axis of lumbar support member 28. Optionally, a smaller version of lumbar support member 28 can be added to support the lumbar region of an infant.

Lumbar support pillow 10 is also appropriate for supporting a person in a lateral recumbency or lying down position for other uses in addition to breast feeding. Examples of other uses for lumbar support pillow 10 include helping to support and maintain the position of a person in this lateral recumbent position on their side during pregnancy, for injuries to a person's side or back, such as muscular injuries, cuts or abrasions that need to have contact with surfaces minimized, conditions such as hemorrhoids and applications of topical treatments such as creams, powders or bandages. Lumbar support pillow 10 will perform this same function with these various other applications, that function being to provide additional support to maintain the lateral recumbency position while reducing fatigue and effort required to maintain this position.

While there is shown and described the present preferred embodiment of the invention, it is to be distinctly understood that this invention is not limited thereto but may be variously embodied to practice within the scope of the following claims.

I claim:

1. A torso and lumbar support and position stabilizing pillow for a lateral recumbency position comprising:

a substantially planar base member;

a main body having a top surface, a bottom surface, a pair of end surfaces and an inside surface wherein the bottom surface is planar and attached to the base member, the end surfaces are planar and perpendicular to the base member and the inside surface is concave and disposed at an acute angle with respect to the base member; and a lumbar support member having a longitudinal axis, a back surface, a front surface having a center, and a pair of end surfaces wherein the back surface is shaped to conform to the inside surface of the main body and attached to the inside surface of the main body, the front surface is substantially convex shaped to provide support to the lumbar region of a person's back and the pair of end surfaces extend between the front and back surfaces, said lumbar support member end surfaces are substantially convex, wherein the base member, main body and lumbar support member are each symmetrical with respect to a plane perpendicular to the longitudinal axis of the lumbar support member at the midpoint of the longitudinal axis.

2. The support pillow of claim 1 wherein the pillow is made from foam rubber.

3. The support pillow of claim 1 wherein the pillow is fabricated as an inflatable structure.

4. The support pillow of claim 1 wherein the pillow is of unitary construction.

5. A torso and lumbar support and position stabilizing pillow for a woman while breast feeding in a lateral recumbency position comprising:

a substantially planar base member;

a main body having a top surface, a bottom surface, a pair of end surfaces and an inside surface wherein the bottom surface is planar and attached to the base member, the end surfaces are planar and perpendicular to the base member and the inside surface is concave and disposed at an acute angle with respect to the base member; and a lumbar support member having a longitudinal axis, a back surface, a front surface having a center, and a pair of end surfaces wherein the back surface is shaped to conform to the inside surface of the main body and attached to the inside surface of the main body, the front surface is substantially convex shaped to provide support to the lumbar region of a person's back and the pair of end surfaces extend between the front and back surfaces, said lumbar support member end surfaces are substantially convex and, wherein the base member, main body and lumbar support member are each symmetrical with respect to a plane perpendicular to the longitudinal axis of the lumbar support member at the midpoint of the longitudinal axis.

6. The support pillow of claim 5 wherein the pillow is made from foam rubber.

7. The support pillow of claim 5 wherein the pillow is fabricated as an inflatable structure.

8. The support pillow of claim 5 wherein the pillow is of unitary construction.

9. A system for torso and lumbar support while breast feeding comprising:

a torso and lumbar support and position stabilizing pillow for a woman while breast feeding in a lateral recumbency position comprising:

a substantially planar base member;

a main body having a top surface, a bottom surface, a pair of end surfaces and an inside surface wherein the bottom surface is planar and attached to the base member, the end surfaces are planar and perpendicular to the base member and the inside surface is concave and disposed at an acute angle with respect to the base member; and a lumbar support member having a longitudinal axis, a back surface, a front surface having a center, and a pair of end surfaces wherein the back surface is shaped to conform to the inside surface of the main body and attached to the inside surface of the main body, the front surface is substantially convex shaped to provide support to the lumbar region of a person's back and the pair of lumbar support member end surfaces extend between the front and back surfaces, said end surfaces are substantially convex, wherein the base member, main body and lumbar support member are each symmetrical with respect to a plane perpendicular to the longitudinal axis of the lumbar support member at the midpoint of the longitudinal axis and an auxiliary and separate support pillow for roll-prevention and support of the feeding infant, wherein the auxiliary and separate support pillow has shape characteristics similar to the main body of said support pillow for the breastfeeding woman.

* * * * *